US011473410B1

(12) United States Patent
Batarseh

(10) Patent No.: US 11,473,410 B1
(45) Date of Patent: Oct. 18, 2022

(54) HYBRID PERFORATION TOOL AND METHODS

(71) Applicant: Saudi Arabian Oil Company, Dhahran (SA)

(72) Inventor: Sameeh Issa Batarseh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/487,401

(22) Filed: Sep. 28, 2021

(51) Int. Cl.

| | |
|---|---|
| ***E21B 43/117*** | (2006.01) |
| ***E21B 7/15*** | (2006.01) |
| ***E21B 7/14*** | (2006.01) |
| ***E21B 43/116*** | (2006.01) |

(52) U.S. Cl.
CPC ..... *E21B 43/117* (2013.01); *E21B 7/14* (2013.01); *E21B 7/15* (2013.01); *E21B 43/116* (2013.01)

(58) Field of Classification Search
CPC ..... E21B 43/116; E21B 43/117; E21B 7/14; E21B 7/15
See application file for complete search history.

(56) References Cited

U.S. PATENT DOCUMENTS

| | | | |
|---|---|---|---|
| 4,862,804 | A | 9/1989 | Chawla et al. |
| 5,413,045 | A | 5/1995 | Miszewski |
| 6,888,097 | B2 | 5/2005 | Batarseh |
| 7,490,664 | B2 | 2/2009 | Skinner et al. |
| 8,678,087 | B2 | 3/2014 | Schultz et al. |
| 8,950,480 | B1 | 2/2015 | Strickland |
| 9,932,803 | B2 | 4/2018 | Batarseh et al. |
| 10,094,172 | B2 * | 10/2018 | Wang ..... E21B 43/26 |
| 10,941,618 | B2 | 3/2021 | Batarseh |
| 10,941,637 | B2 | 3/2021 | Skinner et al. |
| 2016/0319651 | A1 | 11/2016 | Willimas et al. |
| 2020/0392824 | A1 | 12/2020 | Batarseh et al. |
| 2020/0408042 | A1 | 12/2020 | Faircloth et al. |

* cited by examiner

*Primary Examiner* — Yong-Suk (Philip) Ro
(74) *Attorney, Agent, or Firm* — Bracewell LLP; Constance G. Rhebergen; Eleanor L. Tyson

(57) ABSTRACT

A method of using a hybrid tool to perforate a formation comprising the steps of deploying a hybrid tool into a wellbore positioned in the formation; activating a laser beam from the swivel laser head of the hybrid tool; and drilling a tunnel with the laser beam, Followed by, reducing a power of the laser; operating the laser beam at the heating power such that a first spherical heat zone expands from the first point; and drilling a second span of tunnel extending from the first point to a second point. Finally, reducing the power of the laser beam to the heating power; operating the laser beam at the heating power to increase the temperature at the second point such that a second spherical heat zone expands from the second point; and detonating the shaped charged aligned with a targeted perforation path with detonating cord.

11 Claims, 13 Drawing Sheets

Rock Sample

After 5 minutes of heating

Heat source

Heat source

After 10 minutes of heating

HYBRID PERFORATION TOOL AND METHODS

TECHNICAL FIELD

Disclosed are apparatus and methods for perforation. More specifically, embodiments related to apparatus and methods that incorporate lasers and shaped charges for perforation of reservoirs are provided.

BACKGROUND

Shaped charges are used to create perforates in wellbores. Current shaped charges have several limitations including control over the depth, orientation, geometry and shape of the tunnel. Such limitations are due to, in part, to when the reservoir stress overcomes the power of the shaped charges, effecting the perforated tunnel.

High power laser technology is a thermal based process where the high temperatures can melt, spall, or vaporize formation rocks, and at lower temperatures can weaken the formation. Laser technology has attracted the oil and gas industry for several years due to the unique properties of the lasers such as precision, reliability, control and cost. The advantage of the laser is that it penetrates all types of formations regardless of the hardness and stress orientation. Laser technology has several advantages including the ability to drill in different types of rock, drill different hole sizes, be precise in orienting the beam to create the hole, and it is stress and structure independent.

High power laser technology has the potential to be an alternative to current conventional shaped charge perforation guns, however, there is a challenge in delivering the energy from the surface to the target location. If the energy transport is via fiber optics there is more than 60% power loss such that the energy delivered to the target is low and will not be sufficient to create a large perforating tunnel.

SUMMARY

Disclosed are apparatus and methods for perforation. More specifically, embodiments related to apparatus and methods that incorporate lasers and shaped charges for perforation of reservoirs are provided.

In a first aspect, a method of using a hybrid tool to perforate a formation is provided. The method includes the steps of deploying a hybrid tool into a wellbore positioned in a formation, where the hybrid tool includes a swivel laser head and a shaped charge, activating a laser beam from the swivel laser head of the hybrid tool, drilling a tunnel with the laser beam such that the tunnel extends from the wellbore to a first point, where the laser beam operates at a drilling power between 2 kW and 6 kW, reducing a power of the laser beam at the first point to a heating power, where the heating power is less than the power to melt the formation, operating the laser beam at the heating power to increase the temperature at the first point such that a first spherical heat zone expands from the first point, increasing the power of the laser to the drilling power, drilling a second span of tunnel extending from the first point to a second point, reducing the power of the laser beam to the heating power, operating the laser beam at the heating power to increase the temperature at the second point such that a second spherical heat zone expands from the second point, where a volume of the second spherical heat zone is less than a volume of the first spherical heat zone, where the tunnel, first spherical heat zone, and second spherical heat zone form a thermal gradient, ceasing operating of the laser beam, and detonating the shaped charged aligned with a targeted perforation path with detonating cord, where the thermal gradient compensates for a stress orientation of a reservoir stress in the formation to produce a perforation that aligns with the targeted perforation path.

In certain aspects, the method further includes the steps of increasing the power of the laser to the drilling power, drilling a third span of tunnel extending from the second point to a third point, reducing the power of the laser beam to the heating power, and operating the laser beam at the heating power to increase the temperature at the third point such that a third spherical heat zone expands from the third point, where a volume of the third spherical heat zone is less than the volume of the second spherical heat zone, such that the thermal gradient further includes the third spherical heat zone. In certain aspects, the swivel laser head is below the shaped charge. In certain aspects, the swivel laser head is above the shaped charge. In certain aspects, the stress orientation is toward the surface. In certain aspects, the stress orientation is away from the surface. In certain aspects, the stress orientation is perpendicular to the hybrid tool. In certain aspects, the stress orientation is parallel to the hybrid tool. In certain aspects, the method further includes the step of determining the stress orientation from log data of the formation. In certain aspects, the method further includes the step of determining the targeted perforation path from log data of the formation.

In a second aspect, a hybrid tool for perforating a formation includes a swivel laser head configured to emit a laser beam, a shaped charge configured to detonate into the formation, and a body to hold the swivel laser head and shaped charge. In certain embodiments, the swivel laser head further includes a fiber optics cable configured to transmit the laser beam from a surface to the swivel laser head, a rotational wheel configured to pivot the swivel laser head, retraction wheels configured to stabilize the fiber optics cable as the rotation wheel pivots the swivel laser head, an optics assembly configured to shape and manipulate the laser beam from the fiber optics cable, and a sensor configured to transmit data to the surface.

BRIEF DESCRIPTION OF THE DRAWINGS

These and other features, aspects, and advantages will become better understood with regard to the following descriptions, claims, and accompanying drawings. It is to be noted, however, that the drawings illustrate only several embodiments and are therefore not to be considered limiting of the inventive scope as it can admit to other equally effective embodiments.

In the accompanying Figures, similar components or features, or both, may have a similar reference label.

DETAILED DESCRIPTION

While the scope will be described with several embodiments, it is understood that one of ordinary skill in the relevant art will appreciate that many examples, variations and alterations to the apparatus and methods described are within the scope and spirit of the embodiments. Accordingly, the embodiments described here are set forth without any loss of generality, and without imposing limitations. Those of skill in the art understand that the inventive scope includes all possible combinations and uses of particular features described in the specification. In both the drawings and the detailed description, like numbers refer to like elements throughout.

Properties of Lasers

Figure 1:
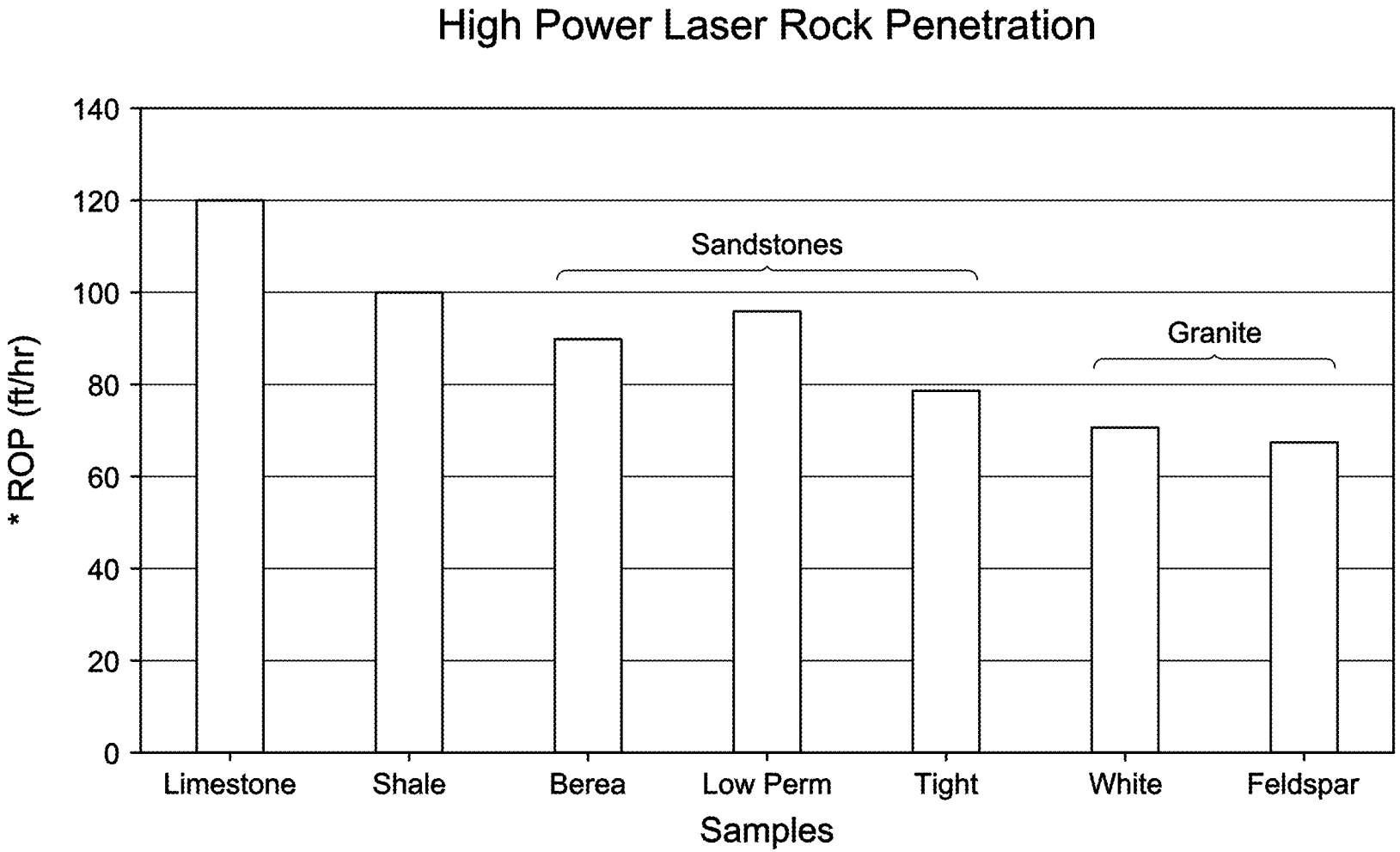
FIG. 1 is a graphic representation of perforation rate created by laser in different formation materials.

The use of lasers in the oil and gas industry have a number of advantages. First, lasers can be used to drill in all rock types including hard formations such as granite as shown in FIG. 1. In FIG. 1, *ROP stands for rate of penetration. THE *ROP provides a measurement for scaling purposes.

Figure 2B:
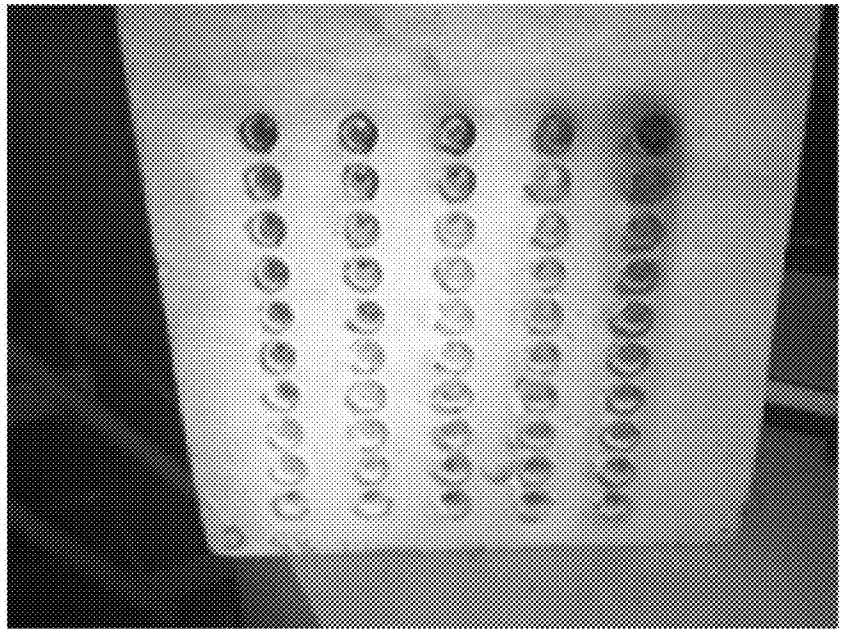
FIG. 2B is a photograph of perforations created by a laser.
Figure 2A:
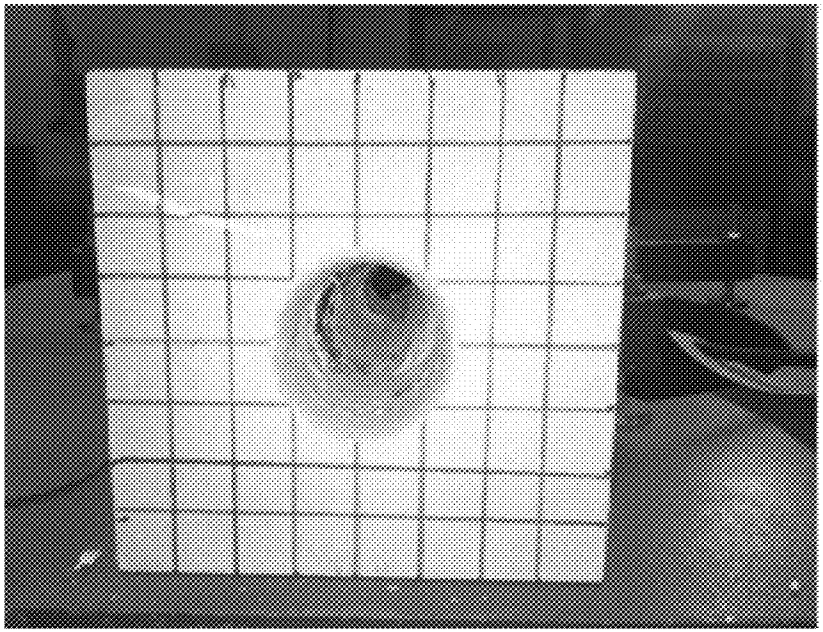
FIG. 2A is a photograph of perforations created by a laser.

Second, lasers can be used to drill different sized holes with control over shape and geometry of the hole. As shown in FIG. 2A and FIG. 2B, in sandstone blocks the laser can drill large holes (FIG. 2A) and small holes (FIG. 2B).

Figure 4:
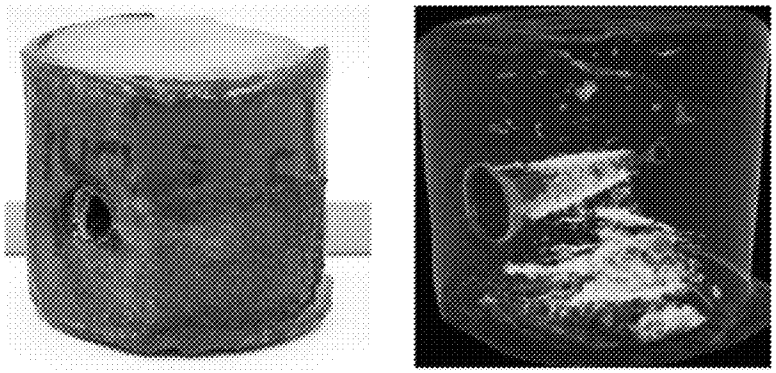
FIG. 4 is a photograph and CT scan of a perforation created by a laser.
Figure 3:
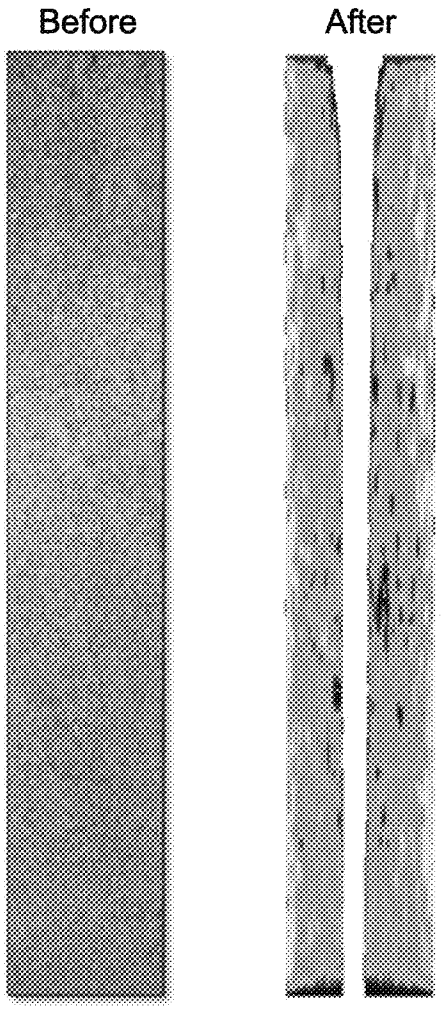
FIG. 3 is a photograph and CT scan of a perforation created by a laser.

In addition to control over shape and geometry, a third advantage of lasers is that the holes formed by lasers are symmetrical and uniform and of high quality as shown by the CT scans of FIGS. 3 and 4. FIG. 3 provides a before and after of a hole formed by a laser and shows the symmetry and uniform nature of the laser bore. FIG. 4 shows the hole geometry of a single laser hole on the left is the sleeved rock showing the hole in the sleeve and the CT scan on the right shows the hole penetrating the rock and created a symmetrical hole. The CT scan in FIG. 4 also shows the orientation of the tunnel created by the laser.

Figure 5:
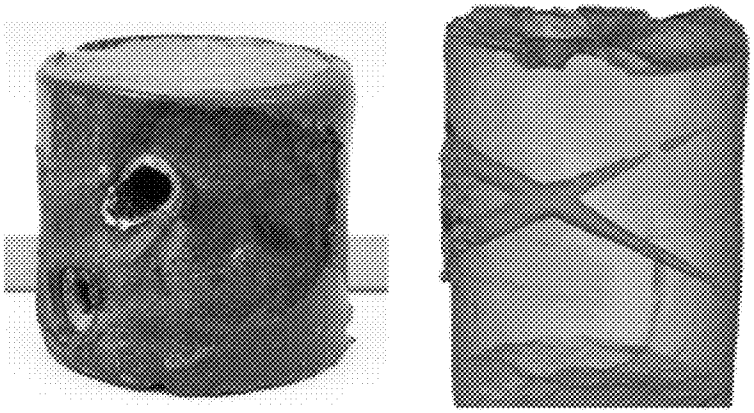
FIG. 5 is a photograph and CT scan of a perforation created by a laser.

A fourth advantage is the precision and ability to control the laser, as shown in the experiment illustrated in FIG. 5. In this experiment two holes were created with the objective to make the tunnels formed by the laser cross each other. The purpose was to evaluate the control of the laser beam orientations and to show that the laser can go in any direction precisely. In FIG. 5 the sample is shown with two holes in the sleeve on the left and the CT scan is the image on the right. The CT scan shows the geometry and the orientation of the two crossed tunnels formed by the laser.

Figure 6:
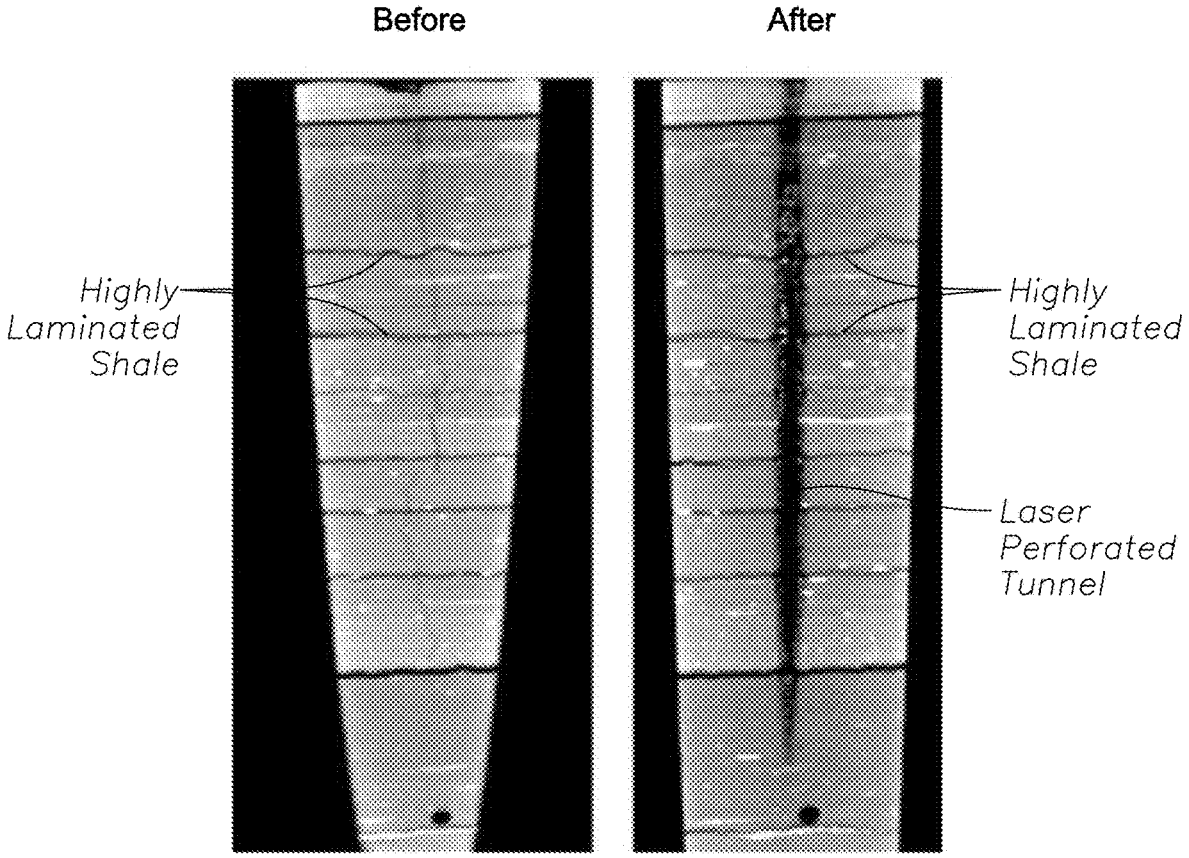
FIG. 6 is a CT scan of a perforation created by a laser.
Figure 7:
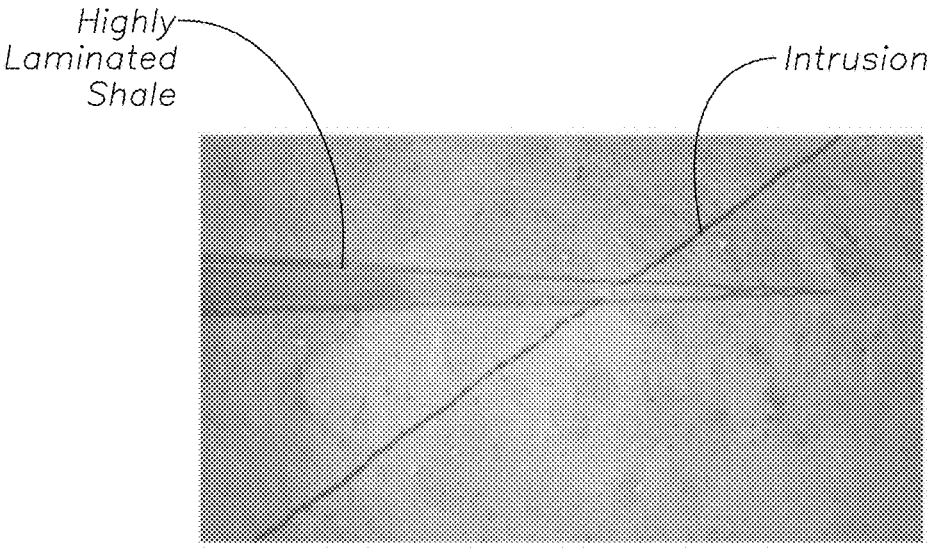
FIG. 7 is a CT scan of a perforation created by a laser.

Finally, a fifth advantage of lasers is the ability to penetrate a formation regardless of the heterogeneity of the rock or stress and structural variations with the result presented in FIG. 6. A sample of a highly laminated shale was perforated with a laser to create a tunnel. FIG. 6 shows the highly laminated shale before laser perforation and after. As shown in FIG. 6, the laser still creates a precise, symmetrical, and uniform tunnel in a highly laminated shale. The ability of the laser to perforate the formation and create a tunnel did not get effected or influenced by the highly laminated formation. Another example of the ability of the laser to penetrate rock with variation in structure is shown in FIG. 7. This sample had mineral intrusion, where the vein has different mineralogy and still the laser penetrated the rock sample without deviation of the tunnel.

Figure 9B:
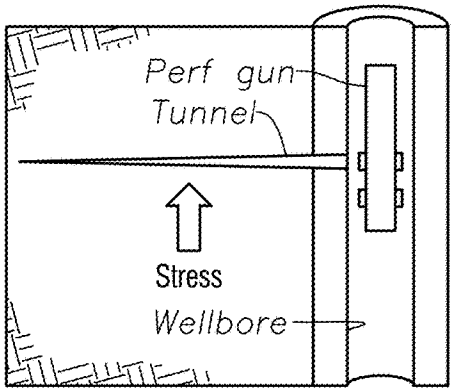
FIG. 9B (Prior Art)
FIG. 9B is an embodiment depicting the reservoir stress on a tunnel formed by a perforation gun of the prior art.
Figure 9A:
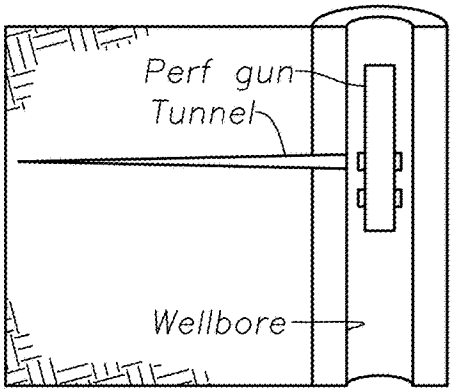
FIG. 9A (Prior Art)
FIG. 9A is an embodiment depicting the reservoir stress on a tunnel formed by a perforation gun of the prior art.
Figure 10B:
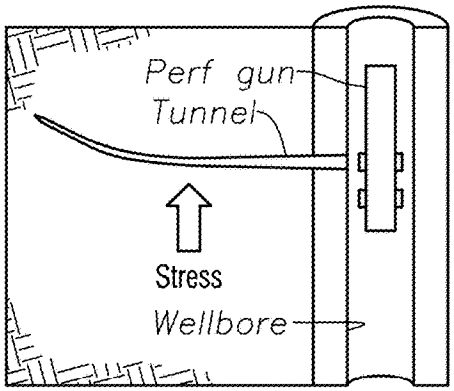
FIG. 10B (Prior Art)
FIG. 10B is an embodiment depicting the reservoir stress on a tunnel formed by a perforation gun of the prior art.
Figure 10A:
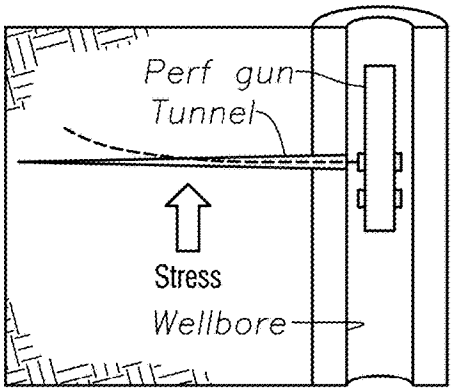
FIG. 10A (Prior Art)
FIG. 10A is an embodiment depicting the reservoir stress on a tunnel formed by a perforation gun of the prior art.
Figure 8:
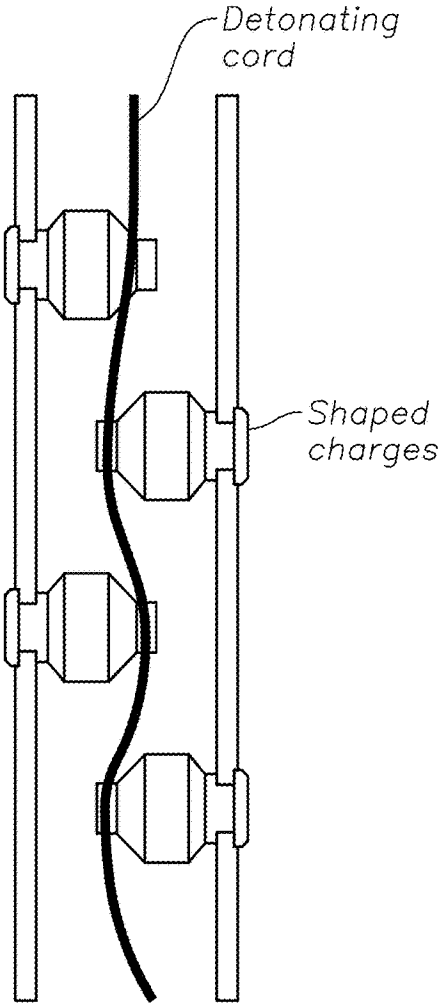
FIG. 8 (Prior Art)
FIG. 8 is an elevation view of a perforation gun of the prior art.

Shaped charges are downhole tools or guns that utilize explosives to perforate the formation. The gun includes a detonating cord and the shaped charges as shown in the simplified sketch of FIG. 8. One of the challenges of shaped charges is the limited control over the geometry of the tunnel and the depth. As the charges are triggered by the detonating cord, the explosives react and explode pushing the charges into the casing and formation away from the wellbore. Initially, the shaped charges penetrate effectively due to their extremely high speed and power, as shown in FIG. 9A. However, as the shaped charge loses speed and power, stresses in a reservoir (shown in FIG. 9B) can change the path of the tunnel as shown in FIG. 10A. As shown in FIGS. 9B and 10A, a reservoir stress below the perforation tunnel can cause the tunnel to deviate following a path of less resistance indicated by the dotted line and the tunnel will deviate as seen in FIG. 10B.

Figure 11:
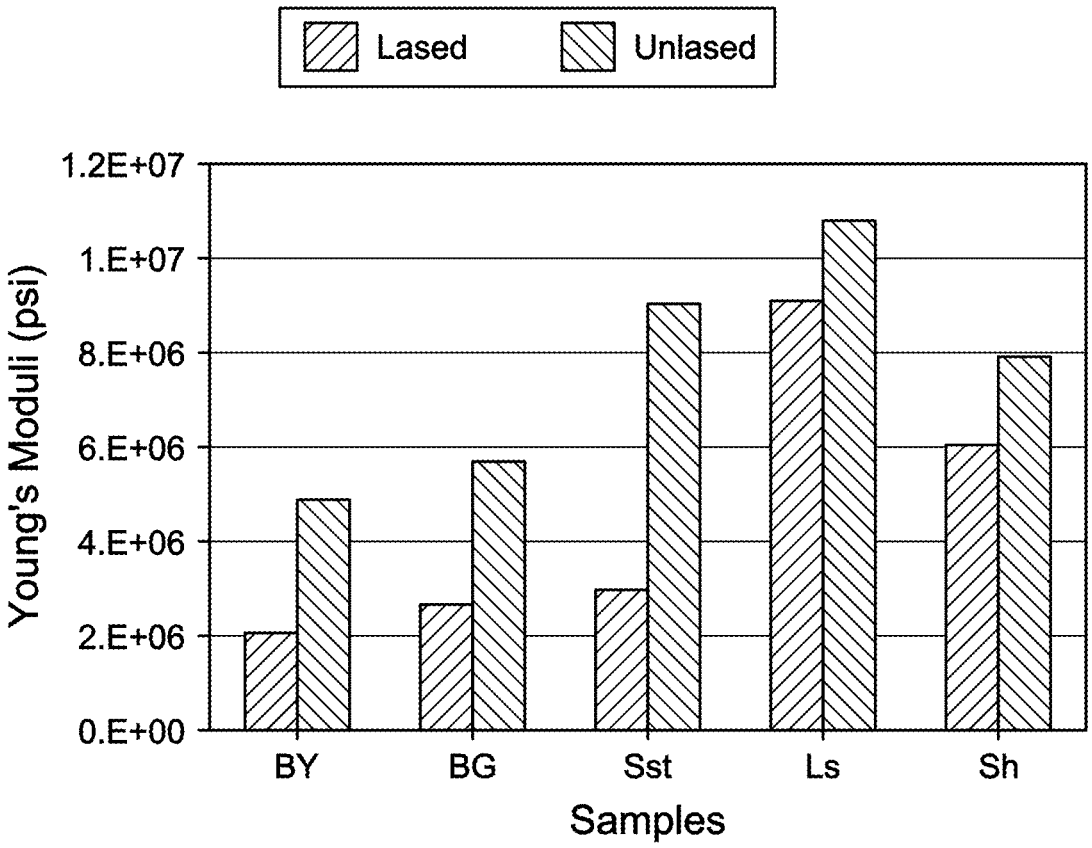
FIG. 11 is a graph of Young's modulus for different rock samples.

Described is a hybrid perforation tool combining a shaped charge gun with laser technology. The laser technology of the hybrid perforation tool weakens the formation to create a zone that can compensate for the reservoir stress. This is based on the fact that the heat generated by the laser weaken the rocks and formation as shown in FIG. 11. FIG. 11 shows the effect on Young's Modulus, or the measure of a rock's resistance to deformation. In FIG. 11, BY, BG, Sst, Ls, and Sh refer to different types of rock: BY refers to Berea Yellow, BG refers to Berea Gray, Sst means sandstone, Ls means limestone, and Sh means shale. As shown in FIG. 11, exposing the rock to laser reduces the Young's modulus of the rock.

The apparatus and methods described integrate the shaped charge gun with laser technology to produce a hybrid tool. The apparatus and methods described improve perforation operation by integrating current shaped charge perforation gun with high power laser technology. The hybrid tool described works on the principle that the laser beam emitted above or below the path of the shaped charges create a tunnel with a thermal gradient to compensate for the reservoir stress. This thermal gradient, caused by differently sized heated zones, will direct and influence the shaped charges.

Advantageously, the hybrid tool enables effective perforation operation with controlled tunnel creation by utilizing high power laser energy to create a thermal gradient that compensates for the reservoir stress. Advantageously, existing shaped charge perforation guns can be modified with high power laser technology by adding laser heads to produce the hybrid tool. Advantageously, the thermal gradient compensates for the stress orientation by counteracting the reservoir stress that would otherwise force the perforation perpendicularly out from the shaped charge. Advantageously, the hybrid tool improves shaped charge perforations. Advantageously, the hybrid tool improves laser materials interaction. Advantageously, the hybrid tool improves materials removal. Advantageously, the hybrid tool reduces or eliminates restrictions on use of shaped charges based on the type of formation, the laser expands the range of formations in which conventional shaped charges are compatible. Advantageously, the apparatus and methods take advantage of the unique features of the high power lasers to improve the shaped charge perforation gun and its performance. Advantageously, the hybrid tool can be created by modifying an existing shaped charge gun with laser components.

As used throughout, "formation properties" refers to the type of formation and the resultant thermal properties, including the melting temperature. The type of formation can be determined by analyzing a sample from the formation and obtaining a chemical analysis. The thermal properties can be determined in a lab by performing differential thermal analysis (DTA). DTA can provide information on transformations of a material, such as glass transitions, crystallization, melting, and sublimation.

As used throughout, "stress orientation" or "stress direction" refers to alignment of the stresses present in the formation due to the rock pressure and fluid pressure. The direction of stress can be determined by the logging and can be plotted relative to cardinal directions (north, south, east, west), or relative to the configuration of the wellbore in the formation.

The hybrid perforation tool is described with reference to FIG. 12A. Hybrid tool 100 includes body 101, swivel laser head 105 and shaped charges 110. Body 101 can be of any size, shape, or material of construction suitable for deployment in a wellbore. Body 101 can be designed to hold swivel laser head 105 and shaped charges 110 along with any associated cabling. Swivel laser head 105 can be any type of laser head that can pivot in arcs from the surface of hybrid tool 100. The ability of swivel laser head 105 to pivot makes swivel laser head 105 capable of orienting and directing laser beam 115. Hybrid tool 100 can include one or more swivel laser head 105. Swivel laser head 105 can be distributed above, below, or in between shaped charges 110.

Figure 12A:
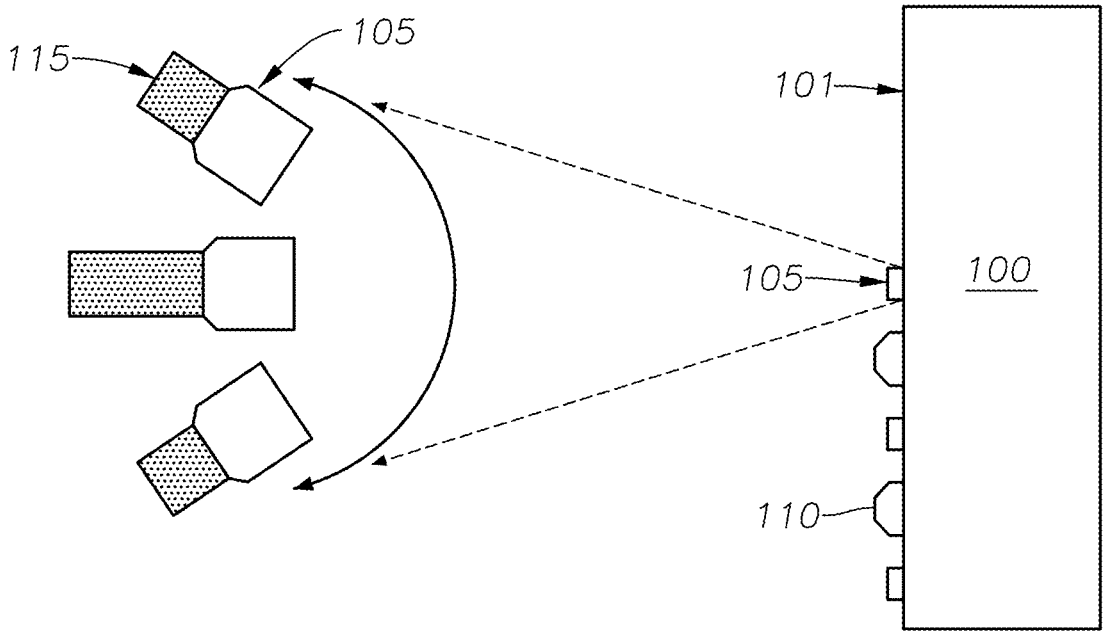
FIG. 12A is an elevation view of an embodiment of the hybrid tool.
Figure 12B:
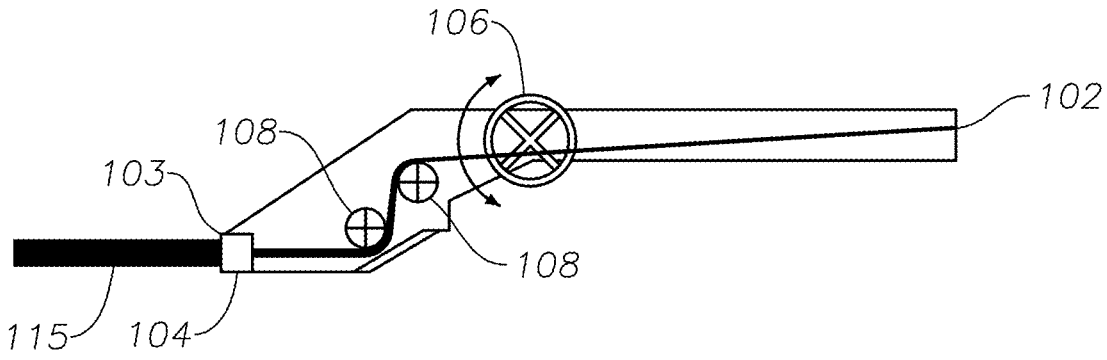
FIG. 12B is an elevation view of an embodiment of the swivel laser head.

Swivel laser head 105 can be understood with reference to FIG. 12B. Laser beam 115 is delivered from the surface by fiber optic cable 102. Fiber optic cable 102 connects laser generation unit positioned on the surface to optics assembly 104. Fiber optic cable 102 can be any type of fiber optic cable capable of carrying a laser beam to swivel laser head 105 with minimal loss of power. Optics assembly 104 includes lenses to control the size, shape and focus of the laser beam from fiber optics cable 102. Rotational wheel 106 controls the angle of swivel laser head 105 enabling swivel laser head 105 to pivot and aim in different direction. Retraction wheels 108 stabilize and control fiber optics cable 102 allowing it to move as swivel laser head 105 moves with rotational wheel 106. Sensor 103 can be positioned in the tip of swivel laser head 105. Sensor 103 can be any type of sensor. Sensor 103 can be a temperature sensor to measure temperature sensor that measures temperature surrounding swivel laser heading 105. Sensor 103 can measure distance to or from a target point in the formation. Sensor 103 can communicate with the surface through cable that runs through swivel laser head 105 or can be a wireless sensor.

Shaped charges 110 can be any type of shaped charges capable of blasting a tunnel into a formation from a wellbore. The shaped charges can be detonated by a detonating cord, such as a coaxial cable, as shown in FIG. FIG. 8. Hybrid tool 100 is in the absence of shaped charges detonated by laser, laser beam 115, or swivel laser head 105, such that shaped charges 110 are not detonated by laser beam 115.

Having both the shaped charges and the swivel laser heads in one tool are advantageous over having two separate tools or two separate strings because it allows for precision in aligning the swivel laser head and the shaped charges relative to each other and it reduces the time between creating the thermal gradient or tunnel with the laser and detonating the shaped charges.

Figure 13A:
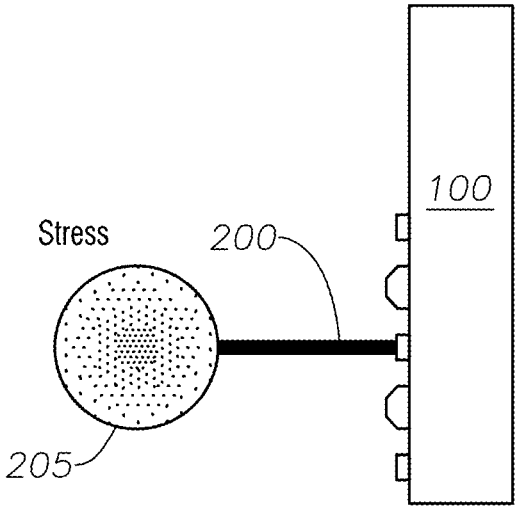
FIG. 13A provides an embodiment of the method of using the hybrid tool.

The method of operating hybrid tool 100 can be understood with reference to FIGS. 13A-13-C and FIG. 12A. Hybrid tool 100 is deployed into a wellbore at the depth in the formation desired based on log data showing stress orientation in the formation. At least one of swivel laser heads 105 is activated to emit laser beam 115 at a drilling power. The drilling power of laser beam 115 is between 2 kW and 6 kW. At the drilling power, laser beam 115 drills tunnel 200 in the formation that extends from the wellbore to a first point. Tunnel 200 has a diameter of between 0.5 inches and 4 inches, alternately between 1 inch and 3 inches, and alternately between 1.5 inches and 2.5 inches. In at least one embodiment, the diameter of tunnel 200 is about 2 inches. In at least one embodiment tunnel 200 begins at the exterior of the wellbore and extends into the formation. In at least one embodiment, laser beam 115 begins from the interior of the wellbore drilling through the casing and cement to the formation. The orientation and distance of the first point from the wellbore is based on the stress orientation in the formation. Laser beam 115 has a continuous energy supply such that laser beam 115 does not lose power along the length of its beam.

At the first point, the power of laser beam 115 is reduced to a heating power. The heating power is less than 2 kW and determined based on the formation properties. The heating power is less than the power needed to melt the formation.

Figure 14:
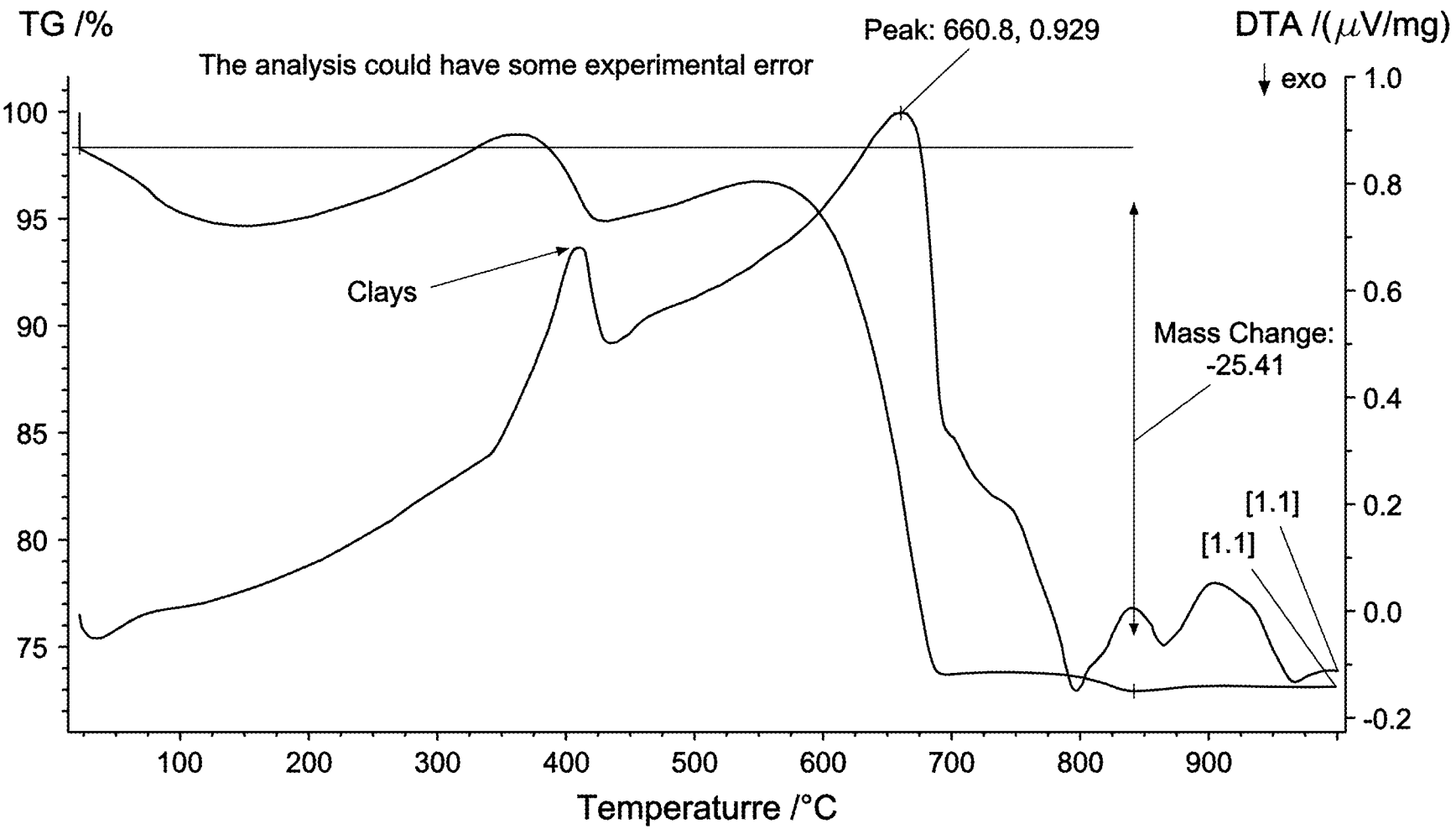
FIG. 14 is an example of the graphical output of from a DTA analysis.

The heating power and drilling power can be determined by looking at the results from a DTA analysis. By way of example, FIG. 14, provides the graphic output from a DTA analysis of a limestone rock sample. Because limestone transformed into lime powder, the peak of 660° C. is considered the dissociation temperature rather than the standard melting temperature, but shows that a peak can be determined. In a standard DTA analysis, such as with sandstone, the highest peak is the melting temperature. By knowing the melting temperature, a power of the laser can be determined and then the power of laser beam 115 can be controlled. If drilling is required, then laser beam 115 can be tuned to exceed the melting temperature by increasing the power allowing laser beam 115 to drill and penetrate the formation making a hole. If heating is required, then the laser power can be lowered causing the temperature to be lower than the melting temperature, such that laser beam 115 will act as a heat source creating a spherical heat zone.

Figure 13B:
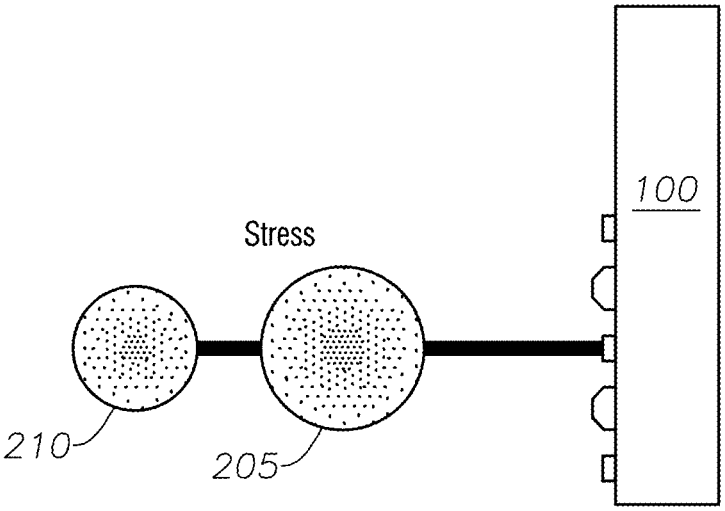
FIG. 13B provides an embodiment of the method of using the hybrid tool.

Laser beam 115 operates at the heating power to increase the temperature at the first point. This creates first spherical heat zone 205 that expands from the first point. The final volume encompassed by first spherical heat zone 205 is a function of the formation properties and the lasing time. The lasing time is the time where the laser operates. The final volume encompassed by first spherical heat zone 205 can be pre-determined by a study of the formation and reservoir logs. When the final volume of first spherical heat zone 205 is achieved, the power of laser beam 115 can be returned to the drilling power to drill additional span of tunnel 200 as shown in FIG. 13B.

The second span of tunnel 200 continues to a second point. At the second point, the power of laser beam 115 is reduced to the heating power. The temperature at the second point is increased and second spherical heat zone 210 is created. As with first spherical heat zone 205 the final volume encompassed by second spherical heat zone 210 is pre-determined and based on the thermal properties of the formation materials and the lasing time. The final volume of second spherical heat zone 210 is less than the final volume of first spherical heat zone 205.

Figure 13C:
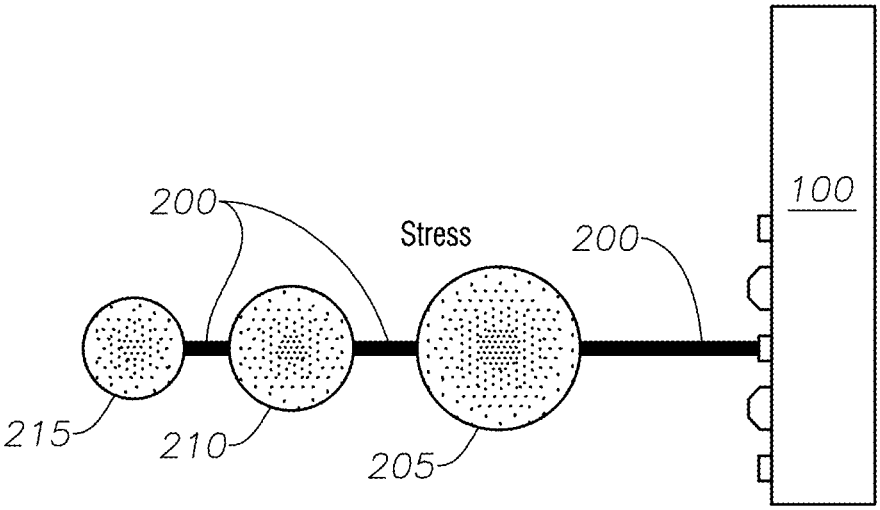
FIG. 13C provides an embodiment of the method of using the hybrid tool.

The process of creating a span of tunnel 200 by operating laser beam 115 at a drilling power and then creating a spherical heat zone by operating laser beam 115 at a heating power can be repeated as needed to compensate for the reservoir stress. The final volume of each spherical heat zone is less than the final volume of the spherical heat zone positioned next closest to the wellbore. As such, the method of using hybrid tool 100 creates a thermal gradient where the final volume of each spherical heat zone is less than the immediately preceding spherical heat zone along tunnel 200. FIG. 13C depicts a span of tunnel 200 with first spherical heat zone 205, second spherical heat zone 210, and third spherical heat zone 215.

The thermal gradient created by the spherical heat zones and the manner in which the thermal gradient compensates for the stress orientation of the reservoir stress can be understood with respect to FIGS. 15-19. One of skill in the art understands that a desired or targeted path for the perforation to be created in the reservoir formation, targeted perforation path 220 can be identified by log data prior to deploying hybrid tool 100. The steps of drilling and finishing wellbore 120 can be performed by any known method suitable for use with shaped charges. The reservoir stress and stress direction can be determined by experimental methods, including log data. One of skill in the art will appreciate that references to wellbore include vertical wellbores, horizontal wellbores and any other orientation wellbores.

Figure 15:
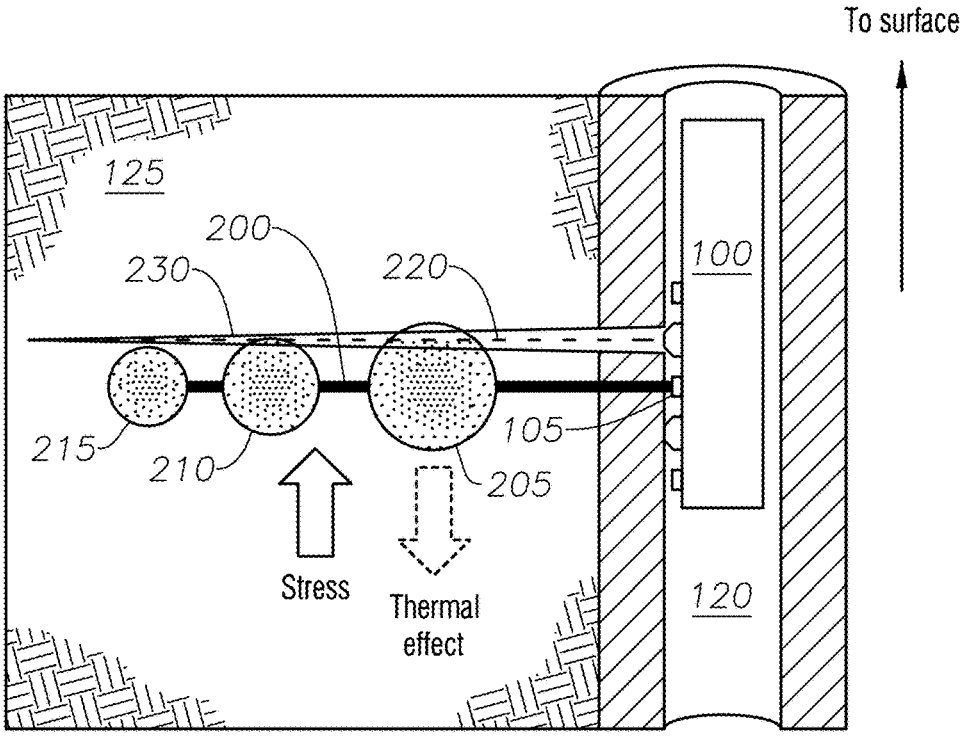
FIG. 15 provides an embodiment of the method of using the hybrid tool.

Referring to FIG. 15, the stress direction is oriented toward the surface, parallel to wellbore 120. Hybrid tool 100 is positioned in wellbore 120 such that one of shaped charges 110 aligns with targeted perforation path 220 with one laser swivel head 105 below shaped charge 110 that aligns with targeted perforation path 220. As positioned, shaped charge 110 that aligns with targeted perforation path 220 will be closer to the surface than laser swivel head 105 below targeted perforation path 220. The relative placement and orientation is illustrated in FIG. 15. Because the stress direction is oriented toward the surface, laser beam 115 from laser swivel head 105 below the aligned shaped charge 110 is activated to produce tunnel 200, first spherical heat zone 205, second spherical heat zone 210, and third spherical heat zone 215 as shown in FIG. 15. The thermal gradient caused by tunnel 200, first spherical heat zone 205, second spherical heat zone 210, and third spherical heat zone 215 weakens formation 125 below targeted perforation path 220 compensating for the stress direction of the reservoir stress. Shaped charge 110 that aligns with targeted perforation path 220 is then detonated and due to the compensation from the thermal gradient will extend in the direction of targeted perforation path 220 to form perforation 230. In the absence of the thermal gradient, the perforation caused by the shaped charge would be impacted by the stress as illustrated in FIG. 10B, because the perforation formed by shaped charges follow the path of least resistance.

Figure 16:
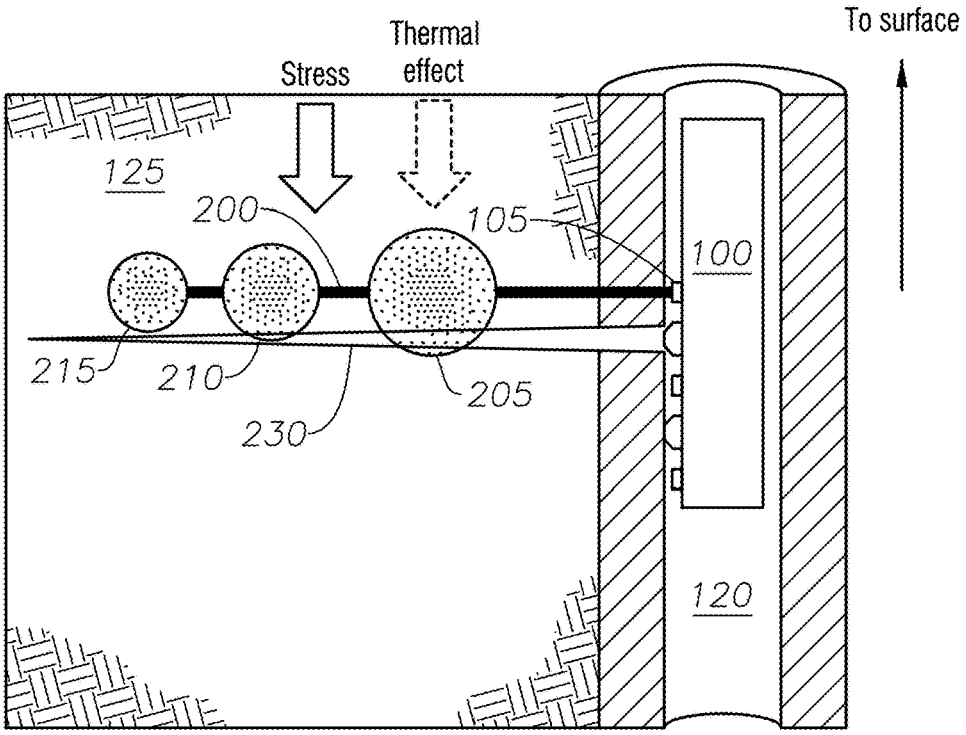
FIG. 16 provides an embodiment of the method of using the hybrid tool.

Referring to FIG. 16, the stress direction is oriented away from the surface, parallel to wellbore 120. Hybrid tool 100 is positioned in wellbore 120 such that one of shaped charges 110 aligns with targeted perforation path 220 with one laser swivel head 105 above shaped charge 110 that aligns with targeted perforation path 220. As positioned, shaped charge 110 that aligns with targeted perforation path 220 will be farther from the surface than laser swivel head 105 above targeted perforation path 220. The relative placement and orientation is illustrated in FIG. 16. Because the stress direction is oriented away from the surface, laser beam 115 from laser swivel head 105 above the aligned shaped charge 110 is activated to produce tunnel 200, first spherical heat zone 205, second spherical heat zone 210, and third spherical heat zone 215 as shown in FIG. 16. The thermal gradient caused by tunnel 200, first spherical heat zone 205, second spherical heat zone 210, and third spherical heat zone 215 weakens formation 125 above targeted perforation path 220 compensating for the stress direction of the reservoir stress. Shaped charge 110 that aligns with targeted perforation path 220 is then detonated and due to the compensation from the thermal gradient will extend in the direction of targeted perforation path 220 to form perforation 230. In the absence of the thermal gradient, the perforation caused by the shaped charge would be impacted by the reservoir stress pushing the perforation in the direction of the stress orientation because the perforation formed by shaped charges follow the path of least resistance.

Figure 17:
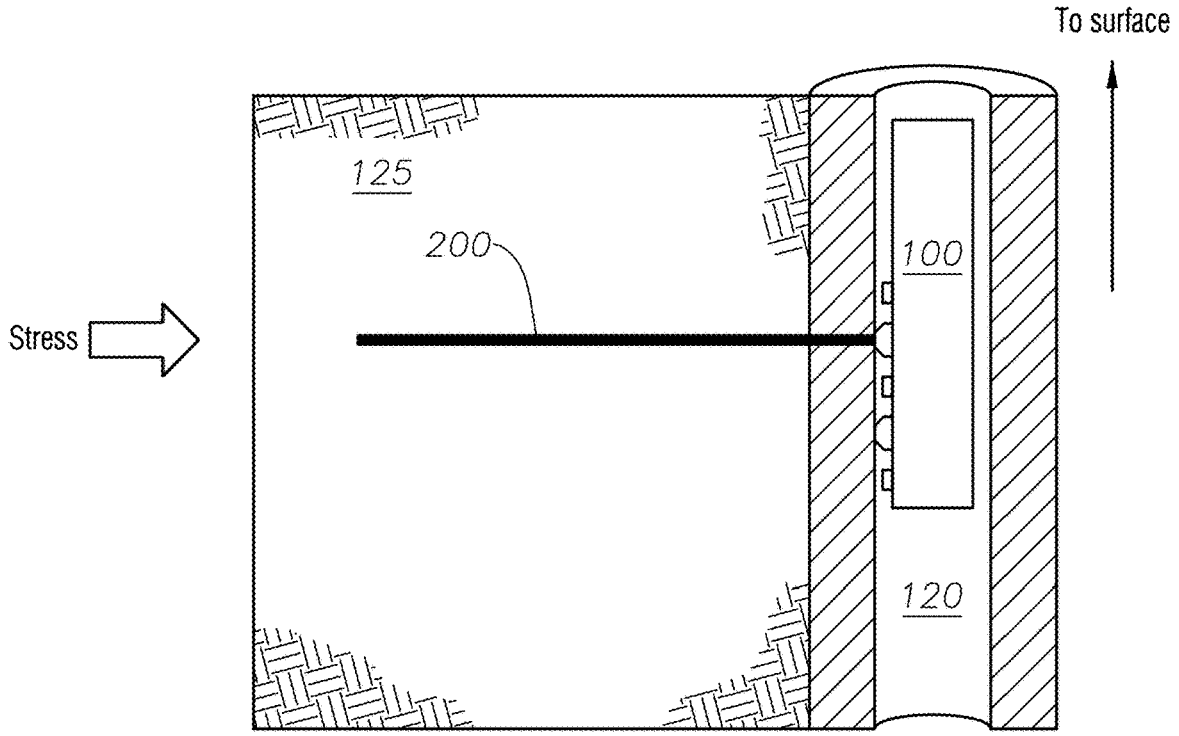
FIG. 17 provides an embodiment of the method of using the hybrid tool.

Referring to FIG. 17, an embodiment is described where the stress direction is oriented perpendicular to wellbore 120 and opposite to targeted perforation path 220. This stress direction limits the penetration depth of the perforation from the wellbore. In the embodiment described with reference to FIG. 17, hybrid tool 100 is positioned in wellbore 120 such that one of shaped charges 110 aligns with targeted perforation path 220 with one laser swivel head 105 above shaped charge 110 that aligns with targeted perforation path 220. As positioned, shaped charge 110 that aligns with targeted perforation path 220 will be farther from the surface than laser swivel head 105 above targeted perforation path 220. The relative placement and orientation is illustrated in FIG. 17. Laser beam 115 above shaped charge 110 is activated to drill tunnel 200, but does not create the thermal gradient. Then shaped charge 110 is detonated.

Figure 18:
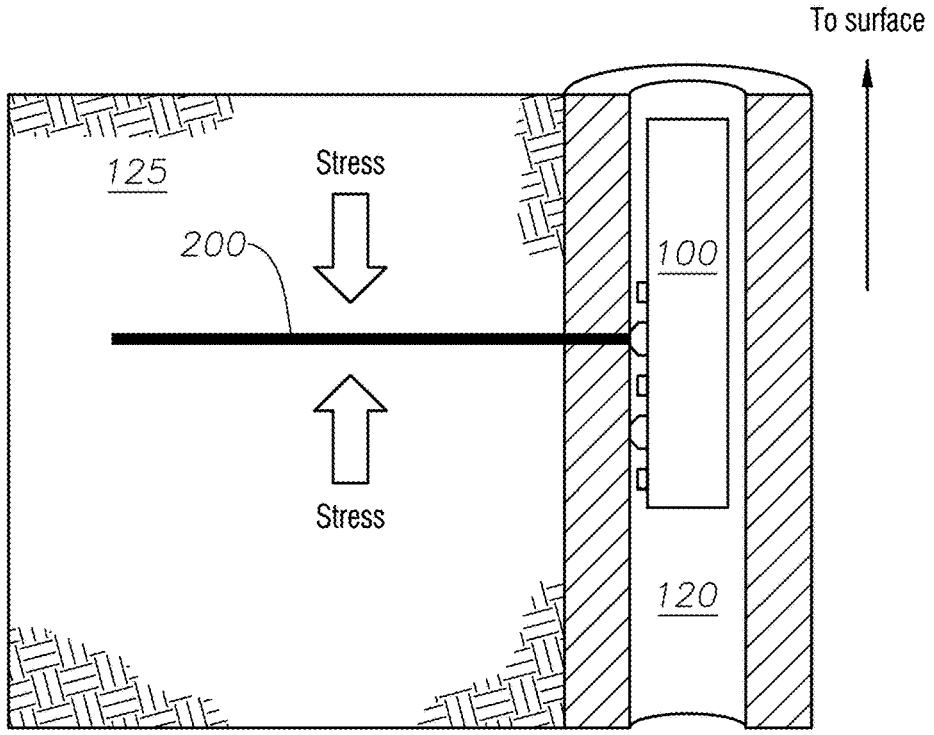
FIG. 18 provides an embodiment of the method of using the hybrid tool.
Figure 19:
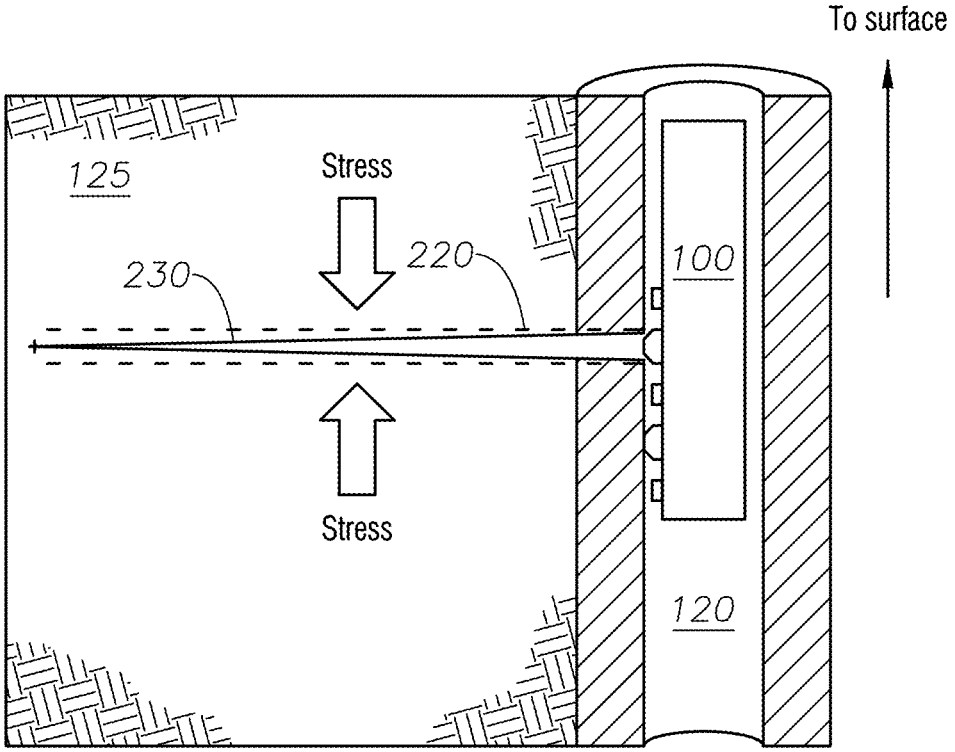
FIG. 19 provides an embodiment of the method of using the hybrid tool.

Referring to FIG. 18, an embodiment is described where the stress direction is minimally oriented in one direction. In the embodiment described with reference to FIG. 18, hybrid tool 100 is positioned in wellbore 120 such that one of shaped charges 110 aligns with targeted perforation path 220 with one laser swivel head 105 above shaped charge 110 that aligns with targeted perforation path 220. As positioned, shaped charge 110 that aligns with targeted perforation path 220 will be farther from the surface than laser swivel head 105 above targeted perforation path 220. The relative placement and orientation is illustrated in FIG. 18. Laser beam 115 above shaped charge 110 is activated to drill tunnel 200, but does not create the thermal gradient. Then shaped charge 110 is immediately detonated. Tunnel 200 has a diameter of between 0.5 inches and 4 inches, alternately between 1 inch and 3 inches, and alternately between 1.5 inches and 2.5 inches. In at least one embodiment, the diameter of tunnel 200 is about 2 inches. Creating tunnel 200 with laser beam 115 first and then immediately detonating shaped charge 110 enables the perforation formed by shaped charge 110 to penetrate to a deeper depth from wellbore 120. In at least one embodiment hybrid tool 100 can be moved after tunnel 200 is created with laser beam 115 to align shaped charge 110 with tunnel 200 before detonating shaped charge 110, as shown in FIG. 19.

One of skill in the art will appreciate that the method of using the hybrid tool does not compensate for the stress orientation if the shaped charges are detonated first and then thermal gradient is created. Without the thermal gradient created by the spherical heat zones created by the laser, the reservoir stress is not compensated for and the perforation will follow the path of least resistance as driven by the stress direction.

The apparatus and methods of the hybrid tool are in the absence of the shaped charges peforating the casing, cement, completion sheath, or any other element of the wellbore surround.

EXAMPLES

Example 1. To demonstrate the ability to create spherical heat zones a rock sample of sandstone was obtained. The melting temperature of sandstone is 1400° C. A laser beam generated by a Ytterbium multiclad fiber laser was pointed to the center of the rock sample and turned to the on position. An IR camera was used to capture the change in temperature as the rock sample increased in temperature. The heating power was 4 kW to keep the temperature below the melting temperature of the rock sample. The heating power was applied to heat the sample for a lasing time of 5 minutes and then for a lasing time of 10 minutes.

Figure 20A:
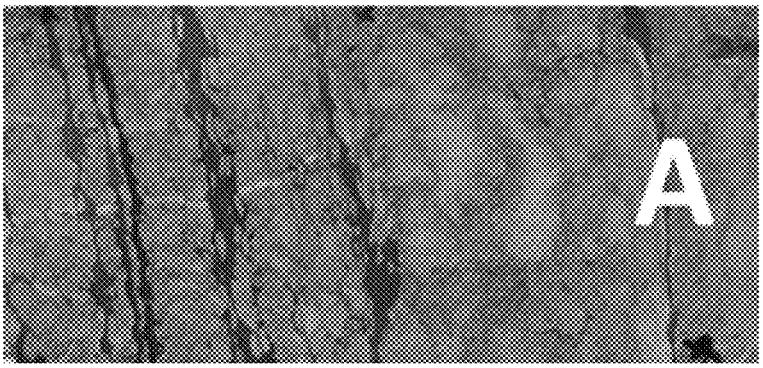
FIG. 20A is an image of a rock sample of Example 1.
Figure 20B:
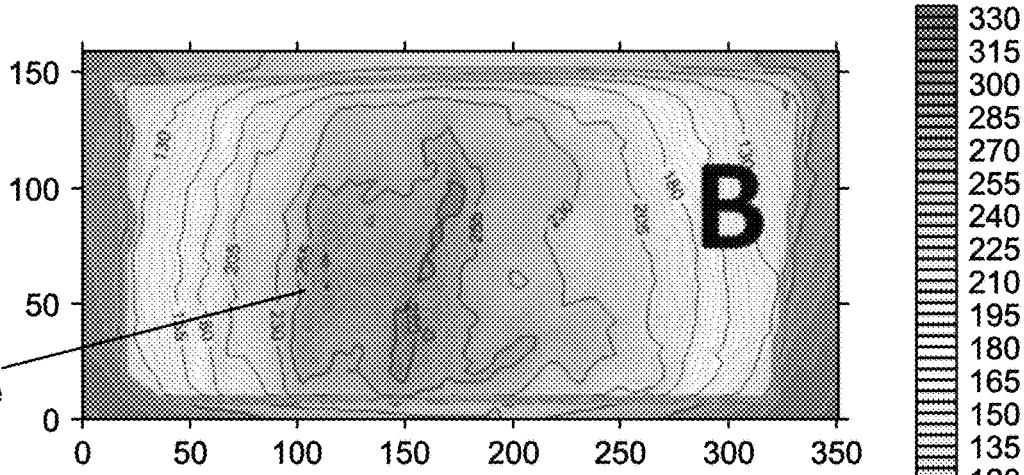
FIG. 20B is an IR image from Example 1.
Figure 20C:
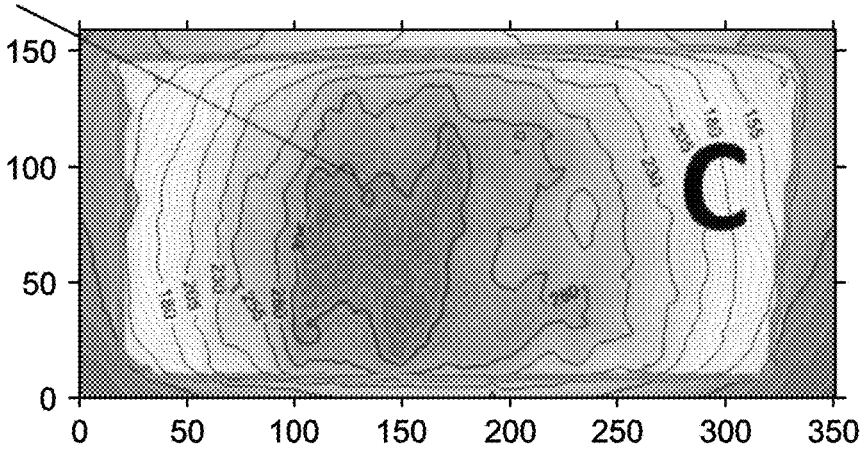
FIG. 20C is an IR image from Example 1.

FIG. 20A shows the rock sample. FIG. 20B and FIG. 20C shows the longer the lasing time increases the temperature and the final volume in the spherical heat zone of the rock sample.

Example 1 demonstrates that a laser can be used to create spherical heat zones of different volumes.

Although the technology has been described in detail, it should be understood that various changes, substitutions, and alterations can be made hereupon without departing from the inventive principle and scope. Accordingly, the scope of the embodiments should be determined by the following claims and their appropriate legal equivalents.

The singular forms "a," "an," and "the" include plural referents, unless the context clearly dictates otherwise.

Optional or optionally means that the subsequently described event or circumstances can or may not occur. The description includes instances where the event or circumstance occurs and instances where it does not occur.

Ranges may be expressed as from one particular value to another particular value. When such a range is expressed, it is to be understood that another embodiment is from the one particular value to the other particular value, along with all combinations within said range.

Terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

As used throughout the disclosure, spatial terms described the relative position of an object or a group of objects relative to another object or group of objects. The spatial relationships apply along vertical and horizontal axes. Orientation and relational words are for descriptive convenience and are not limiting unless otherwise indicated Throughout this application, where patents or publications are referenced, the disclosures of these references in their entireties are intended to be incorporated by reference into this application, in order to more fully describe the state of the art, except when these references contradict the statements made here.

As used here and in the appended claims, the words "comprise," "has," and "include" and all grammatical variations thereof are each intended to have an open, non-limiting meaning that does not exclude additional elements or steps.

What is claimed is:

1. A method of using a hybrid tool to perforate a formation, the method comprising the steps of:

deploying a hybrid tool into a wellbore positioned in the formation, wherein the hybrid tool comprises a swivel laser head and a shaped charge;

activating a laser beam from the swivel laser head of the hybrid tool;

drilling a tunnel with the laser beam such that the tunnel extends from the wellbore to a first point, wherein the laser beam operates at a drilling power between 2 kW and 6 kW;

reducing a power of the laser beam at the first point to a heating power, wherein the heating power is less than the power to melt the formation;

operating the laser beam at the heating power to increase the temperature at the first point such that a first spherical heat zone expands from the first point;

increasing the power of the laser to the drilling power;

drilling a second span of tunnel extending from the first point to a second point;

reducing the power of the laser beam to the heating power;

operating the laser beam at the heating power to increase the temperature at the second point such that a second spherical heat zone expands from the second point, wherein a volume of the second spherical heat zone is less than a volume of the first spherical heat zone, wherein the tunnel, first spherical heat zone, and second spherical heat zone form a thermal gradient;

ceasing operating of the laser beam; and detonating the shaped charged aligned with a targeted perforation path with detonating cord, wherein the thermal gradient compensates for a stress orientation of a reservoir stress in the formation to produce a perforation that aligns with the targeted perforation path.

2. The method of claim 1, further comprising the steps of:

increasing the power of the laser to the drilling power;

drilling a third span of tunnel extending from the second point to a third point;

reducing the power of the laser beam to the heating power; and operating the laser beam at the heating power to increase the temperature at the third point such that a third spherical heat zone expands from the third point, wherein a volume of the third spherical heat zone is less than the volume of the second spherical heat zone, such that the thermal gradient further comprises the third spherical heat zone.

3. The method of claim 1, wherein the swivel laser head is below the shaped charge.

4. The method of claim 1, wherein the swivel laser head is above the shaped charge.

5. The method of claim 1, wherein the stress orientation is toward the surface.

6. The method of claim 1, wherein the stress orientation is away from the surface.

7. The method of claim 1, wherein the stress orientation is perpendicular to the hybrid tool.

8. The method of claim 1, wherein the stress orientation is parallel to the hybrid tool.

9. The method of claim 1, further comprising the step of determining the stress orientation from log data of the formation.

10. The method of claim 1, further comprising the step of determining the targeted perforation path from log data of the formation.

11. A hybrid tool for perforating a formation, the hybrid tool comprising:

a swivel laser head configured to emit a laser beam, wherein the swivel laser head comprises:

a fiber optics cable configured to transmit the laser beam from a surface to the swivel laser head;

a rotational wheel configured to pivot the swivel laser head;

retraction wheels configured to stabilize the fiber optics cable as the rotation wheel pivots the swivel laser head;

an optics assembly configured to shape and manipulate the laser beam from the fiber optics cable; and a sensor configured to transmit data to the surface;

a shaped charge configured to detonate into the formation; and a body to hold the swivel laser head and shaped charge.

* * * * *